US010450668B2

(12) United States Patent
Korinko et al.

(10) Patent No.: US 10,450,668 B2
(45) Date of Patent: Oct. 22, 2019

(54) DEVELOPMENT OF A PASSIVATED STAINLESS STEEL SURFACE

(71) Applicant: Savannah River Nuclear Solutions, LLC, Aiken, SC (US)

(72) Inventors: Paul S. Korinko, Aiken, SC (US); Richard B. Wyrwas, Aiken, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 259 days.

(21) Appl. No.: 15/484,210

(22) Filed: Apr. 11, 2017

(65) Prior Publication Data

US 2018/0291523 A1 Oct. 11, 2018

(51) Int. Cl.
*C25F 3/24* (2006.01)

(52) U.S. Cl.
CPC ..... *C25F 3/24* (2013.01)

(58) Field of Classification Search
CPC ..... C25F 3/24
See application file for complete search history.

(56) References Cited

U.S. PATENT DOCUMENTS

| | | | | |
|---|---|---|---|---|
| 250,575 | A | 12/1881 | Rafelson | |
| 2,411,410 | A | 11/1946 | Beckwith | |
| 4,118,301 | A | 10/1978 | Mayer et al. | |
| 4,314,880 | A | 2/1982 | McGuire et al. | |
| 4,520,077 | A | 5/1985 | Lavezzari | |
| 4,555,275 | A | 11/1985 | Tobin | |
| 5,085,745 | A * | 2/1992 | Farber | C25F 3/24 205/661 |
| 5,741,372 | A | 4/1998 | Gugel | |
| 5,769,966 | A | 6/1998 | Park | |
| 2013/0078382 | A1 | 3/2013 | Hofmann et al. | |
| 2014/0120456 | A1 | 5/2014 | Ramm | |
| 2015/0118411 | A1 | 4/2015 | Cardenas et al. | |
| 2016/0229721 | A1 | 8/2016 | Rissanen | |
| 2016/0238185 | A1 | 8/2016 | Budaragin et al. | |

FOREIGN PATENT DOCUMENTS

| | | |
|---|---|---|
| DE | 2921825 | 12/1980 |
| EP | 1133579 | 9/2001 |
| GB | 1254602 | 11/1971 |
| GB | 1261544 | 1/1972 |

(Continued)

OTHER PUBLICATIONS

Sasaki ("Reducing SS 304/316 hydrogen outgassing to 2×10−15 torr×l/cm2s," J. Vac. Sci. Technol. A 25(4) pp. 1309-1311) (Year: 2007).*

(Continued)

*Primary Examiner* — Nicholas A Smith
(74) *Attorney, Agent, or Firm* — Dority & Manning, P.A.

(57) ABSTRACT

A multi-step Q-passivation method for stainless steel is described. The method includes a first high voltage electropolishing step followed by as separate low voltage chromium enhancement step. The method can also include a vacuum heat treatment step that utilizes a cyclic ramp-up period so as to maintain a relatively low pressure and low temperature throughout the step. The method can also include a controlled oxidation step during which the surface is contacted with an oxygen/inert gas mixture at low oxygen partial pressure.

14 Claims, 22 Drawing Sheets

(56) References Cited

FOREIGN PATENT DOCUMENTS

| | | | | |
|---|---|---|---|---|
| GB | 2009254 | | | 6/1979 |
| KR | 20180107422 | A | * | 10/2018 |
| WO | 81/01298 | | | 5/1981 |

OTHER PUBLICATIONS

AVS, Science & Technology / JVSTA AVS 63'Rd International Symposium & Exhibition Journal of Vacuum Science & Technology Dated Nov. 8-10, 2016. (4 pages).
M. Datta and L.T. Romankiw Journal of the Electrochemical Society Surface Finishing of High Speed Print Bands Dated Jan. 20, 1998. (2 pages).
Petri Kinnunen VTT Research Report Antioxi—Decontamination Techniques for Activity Removal in Nuclear Environments. Dated Dec. 3, 2008. (59 pages).

* cited by examiner

DEVELOPMENT OF A PASSIVATED STAINLESS STEEL SURFACE

STATEMENT REGARDING FEDERALLY SPONSORED RESEARCH OR DEVELOPMENT

This invention was made with government support under Contract No. DE-AC09-08SR22470 awarded by the U.S. Department of Energy. The government has certain rights in the invention.

BACKGROUND

Stainless steel is often treated to render the surface inert to corrosion. In the past, the surface treatment process known as passivation was actually a two-step method that today is differentiated into the two separate processes. Pickling, or descaling, is done to remove scale and to clean the surface. The passivation process takes place following the pickling process in order to provide the surface with desirable characteristics, often including the formation of a protective oxide film coating to prevent interaction with the exterior environment.

While the term passivation is generally used to imply formation of an inert or robust surface, the particular characteristics required for passivation can vary with intended use and levels of quality and can be done using different standards and proprietary methods to achieve various goals. For instance, the term can apply equally to a process that merely renders the surface inert by formation of a thin oxide layer as well as to electrochemical passivation as it occurs during cyclic voltammetry. In applications that involve storage or other contact with gases, and particularly those involving hydrogen isotopes, surface passivation requires that not only should the surface be inert to surface catalytic action, but it should also resist hydrogen outgassing and absorption.

To improve handling and storage of hydrogen isotopes, a stainless steel passivation process has been developed (termed "Q-passivation" where "Q" is a stand-in for the hydrogen isotopes of H, $^2$H, and $^3$H, protium, deuterium, and tritium) that includes electropolishing and vacuum treatment with associated secondary operations (e.g., pickling). Q-passivation can smooth the surface, remove residual hydrogen, and create a chromium and chromium oxide rich surface. An example of a typical Q-passivation technique is described by Sasaki (J. Vac. Sci. Technol. A 25(4), July/August 2007). In the process presented by Sasaki, electropolishing of the surface was performed followed by a vacuum heat treatment to 400° C. It is discussed in this example that the reduction of surface roughness in turn reduced available atomic surface area for hydrogen out-gassing. Q-passivation processes can form a chromium oxide enriched layer that can inhibit the migration of hydrogen liberated from the bulk stainless steel and can also limit surface interaction by diminishing catalytic metal centers on the surface that can react with hydrogen and water. Unfortunately, such methods have exhibited variable and often marginal results, particularly when considered for use with containment vessels, manifold components, etc., for the storage, conveyance, preparation, and characterization of tritium gas. Tritium storage and conveyance is particularly problematic as tritium is not only radioactive but is also highly reactive with many materials. It is easily adsorbed onto and absorbed through the surface of containment vessels. Interaction of tritium with the surface can modify the contained gas composition by isotopic exchange as well as by reaction with surface elements and adsorbed gas species.

Accordingly, what is needed in the art is a process for treating stainless steel that can better render the surface inert to hydrogen out-gassing and inhibit reaction of the substrate with hydrogen and water. Such a process would be highly beneficial for treatment of gas standard bottles and equipment for storage and conveyance of hydrogen isotopes and in particular for tritium. The resulting stainless steel surface could be inert to tritium, minimize isotope exchange between $H_2$ and $D_2$ and minimize catalytic breakdown at the surface.

SUMMARY

According to one embodiment, a method for treating stainless steel and passivating the surface is disclosed. The method includes an electropolishing step in which a surface of a stainless steel object is immersed in an acid bath and a voltage (e.g., from about 1 V to about 10 V) is applied across the bath and between the surface and an electrode. In addition, the method includes a chromium enrichment step. During this step, the surface is immersed in a second acid bath and a second voltage (e.g., from about 500 mV to about 1500 mV) is applied across the bath and between the surface and a second electrode.

Following the electropolishing and chromium enrichment steps, the surface can be subjected to a vacuum treatment during which the surface is heated in a controlled fashion so as to maintain the temperature at the surface (e.g. in the oven) at about 400° C. or less and to maintain the pressure at the surface at about $2.5\times10^{-6}$ Torr or less.

In some embodiments, a method can also include a controlled surface oxidation step during which the surface is contacted with an oxygen/inert gas mixture at low partial pressure of oxygen, optionally while the surface is heated. This thermal oxidation step can increase the thickness of the chromium oxide layer at the surface and minimize the formation of iron oxide at the surface.

Also disclosed is a Q-passivated stainless steel that can be formed by the process. For instance, the stainless steel can include chromium oxide at a surface that extends to a depth of 12 nm or more, for instance from about 15 nm to about 40 nm in some embodiments.

BRIEF DESCRIPTION OF THE FIGURES

A full and enabling disclosure of the present subject matter, including the best mode thereof to one of ordinary skill in the art, is set forth more particularly in the remainder of the specification, including reference to the accompanying figures in which.

Figure 1:
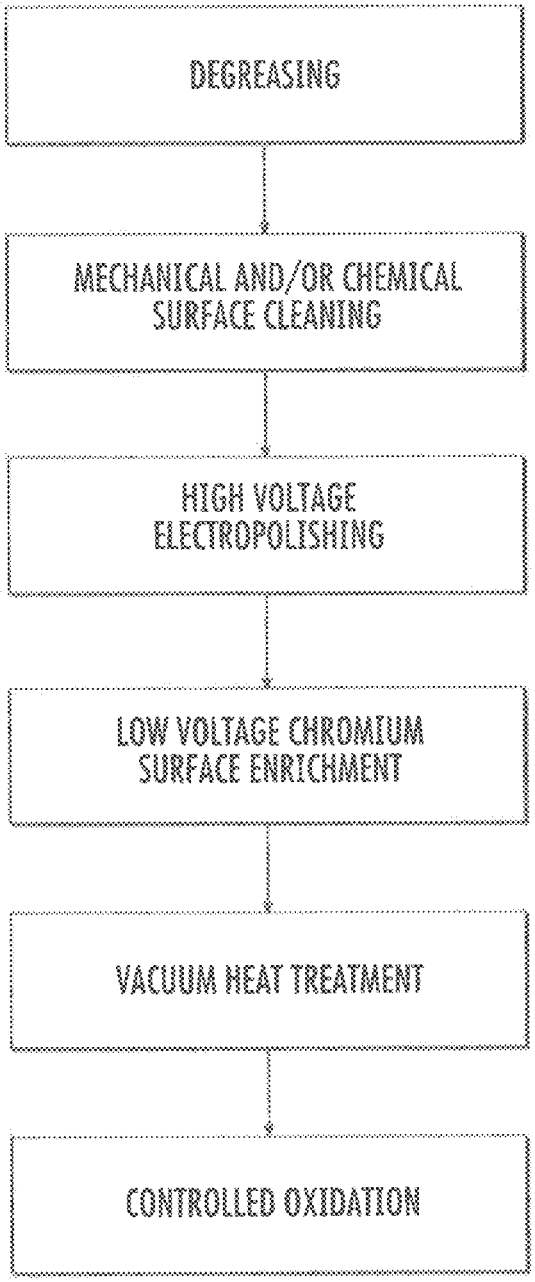
FIG. 1 is a flow diagram illustrating one embodiment of a Q-passivation method as described herein.

Repeat use of reference characters in the present specification and drawings is intended to represent the same or analogous features or elements of the present invention.

DETAILED DESCRIPTION

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made in the present disclosure without departing from the scope or spirit of the subject matter. For instance, features illustrated or described as part of one embodiment, may be used in another embodiment to yield a still further embodiment.

In general, the present disclosure is directed to surface passivation methods that can increase resistance of a stainless steel surface to hydrogen (protium), deuterium, and tritium interaction and passage. Through application of the process, interactions of soluble hydrogen with an internal gas held in a container can be minimized, particularly at a low pressures. For example, out gassing of hydrogen from the bulk stainless steel as well as absorption of hydrogen isotopes can be prevented. Moreover, disclosed methods can prevent surface related interactions of water and hydrogen with potential catalytic sites of the stainless steel.

The passivation method is a multi-step method that incorporates one or more additional steps into a typical Q-passivation approach. In addition to reducing surface roughness, the process can enhance chromium content at the surface and as such the nickel and iron content at the surface can be proportionally decreased. This is advantageous because both nickel and iron have an adverse impact on hydrogen retention, dissociation, and reactivity. For instance, following a passivation procedure as described herein, a stainless steel construct can contain essentially no nickel in approximately the upper 2 nm (i.e., the region spanning from the surface to about 2 nm beneath the surface) and this region can be enhanced in chromium and iron content by about 5% or more, e.g., about 8% or more, for instance up to about 40%, as compared to the content in this region prior to the passivation procedure. In some embodiments, a surface region (e.g., the upper 2 nm) can be free of iron. In some embodiments, the ratio of chromium to iron in approximately the upper 2 nm can be about 1 or greater.

Moreover, through utilization of a controlled oxidation step as described chromium oxide can preferentially form over iron oxide at the surface of the object. For instance, a Q-passivated structure formed as described can exhibit chromium oxide to a depth of about 10 nm or more beneath the surface, such as 12 nm or more, or 15 nm or more. In some embodiments, chromium oxide can extend to a depth of from about 14 nm to about 18 nm, or up to about 40 nm in some embodiments, e.g., from the surface to about 40 nm in depth from the surface. Additionally, chromium oxide can extend deeper into the structure than iron oxide, which can improve the resistance characteristics of the surface. For instance, iron oxide formation can be limited to about 12 nm or less beneath the surface of the structure while chromium oxide can extend deeper as described above.

FIG. 1 is a flow diagram illustrating one embodiment of a Q-passivation process. The process can be utilized to surface passivate any stainless steel and can begin with commercially manufactured components and treat and prepare them for use in one particular embodiment in a hydrogen isotope application. In one particular embodiment, the treated stainless steel can be used in a nuclear facility. By way of example and without limitation, 300 series stainless steel including 304, 304L, 316, 316L, and 321 can be processed.

In general, a stainless steel can be initially cleaned via a degreasing step and a mechanical and/or chemical surface cleaning step, as shown. The initial degreasing step can remove grease, dirt, and other loosely attached contaminants from the surface using common degreasing/cleaning chemicals. Common degreasing chemical can include a simple aqueous wash and/or utilization of a typical organic cleaner such as an alcohol or acetone-based cleaner. For example, in one embodiment an acetone and/or alcohol solution optionally applied at high pressure or with agitation can be used to remove grease and contaminant species that may be present on the surface of a component.

Following any initial degreasing, a surface can be treated to remove scale, e.g., mill scale and/or pre-existing oxide scale, using one or both of a mechanical or chemical surface cleaning. The particular method selected can generally be determined by the surface condition as well as the accessibility of the surface to be treated. For instance, an internal, hard to reach surface that cannot be easily abraded mechanically may be more conducive to a chemical cleaning.

A chemical surface cleaning approach can generally utilize a strong acid solution at elevated temperature. For instance, a solution of nitric acid with ammonium fluoride at a temperature of about 150° C. can be utilized.

Figure 13:
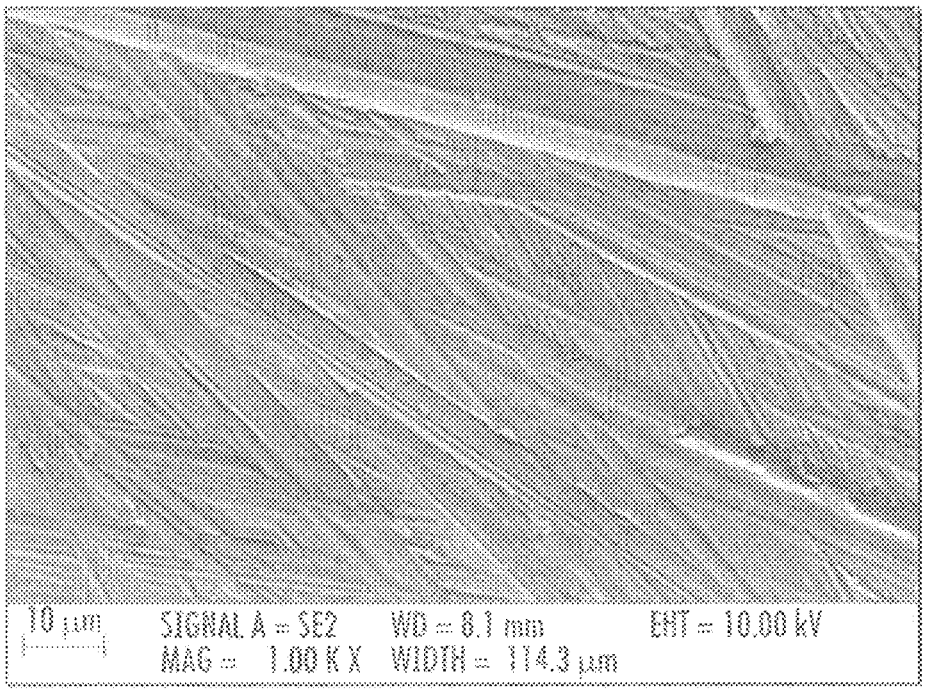
FIG. 13 illustrates a stainless steel surface following a mechanical polishing step.

A mechanical surface cleaning approach can include grit polishing the surface, for instance by use of silicon carbide or alumina grit paper. The mechanical surface cleaning can remove large inconsistencies on the surface, but can leave grinding marks on the surface. For example, FIG. 13 illustrates the surface of a type 300 series stainless steel after mechanical grit polishing.

Figure 2:
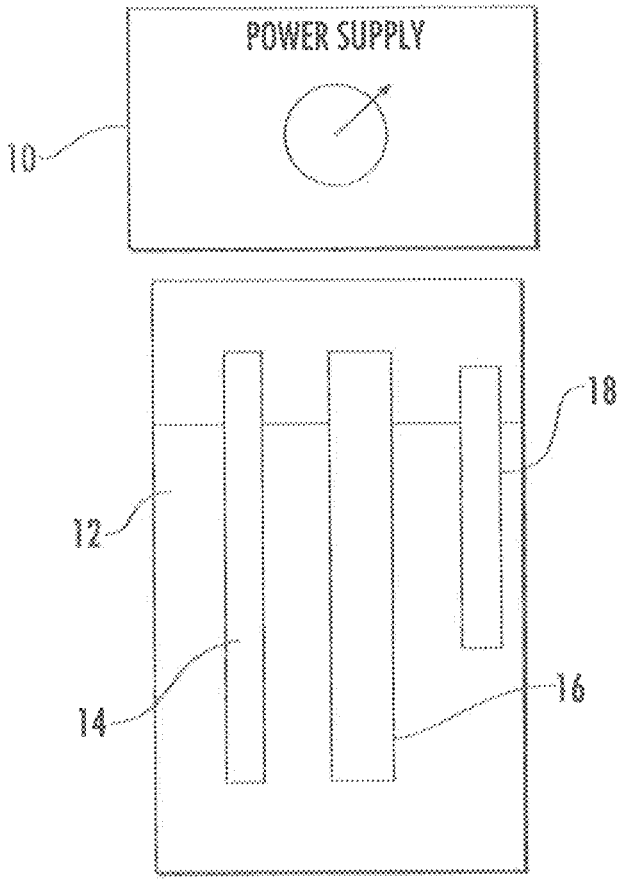
FIG. 2 schematically illustrates an electropolishing bath as may be utilized in a method as described herein.

Following initial cleaning steps, the surface can be subjected to an electropolishing step, during which surface asperities and chemical species can be removed. Thus, electropolishing can result in a uniformly smooth surface. FIG. 2 schematically illustrates an electropolishing bath as may be utilized. As shown, an electropolishing bath can include a power supply 10, an acid bath 12, a counter electrode 14, the work piece 16 that includes stainless steel at an immersed surface to be treated, and a reference electrode 18. The stainless steel of the work piece 16 functions as a working electrode during the electropolishing process. It should be understood that the surface to be treated can encompass the complete surface of an object or only a portion of the object. For instance, an object that is completely formed of stainless steel can be totally immersed in an electropolishing bath, but this is not a requirement of a process, and in other embodiments, only a portion of an object can be immersed. Moreover, an object to be surface treated can be formed of a plurality of different materials, and only a portion of the object need have stainless steel at a surface to be treated.

The acid bath (which functions as the electrolyte during the electropolishing process) can include a mixture of sulfuric and phosphoric acids, as is known. In one embodiment, the acid bath can include sulfuric acid and phosphoric acid in an approximately 50:50 ratio by weight, but this ratio can optionally be varied. For instance, the sulfuric acid can be present in a greater amount as compared to the phosphoric acid, for instance up to about 70:30. The electropolishing method is not limited to these particular electrolyte solutions, however, and other electropolishing electrolytes may alternatively be utilized. For instance, other electropolishing electrolytes as may be utilized as have been reported in the literature include mixtures of perchlorates with acetic anhydride and methanolic solutions of sulfuric acid.

The counter electrode 14 and reference electrode 18 can incorporate any suitable electrode material and structure as is known in the art. By way of example, the counter electrode 14 can include copper, lead, platinum, silver, or other materials as is known to have an appropriate hydrogen overvoltage so as to enhance the polishing.

The stainless steel piece 16 and the counter electrode 14 can both be connected to a power supply 10. The power supply, for instance a battery, can provide an external supply of direct current (DC). Alternatively, the power supply 15 can be an alternate current (AC) power supply having a frequency ranging from 1 Hz to 1000 Hz, generally employed in combination with a rectifier.

Figure 3:
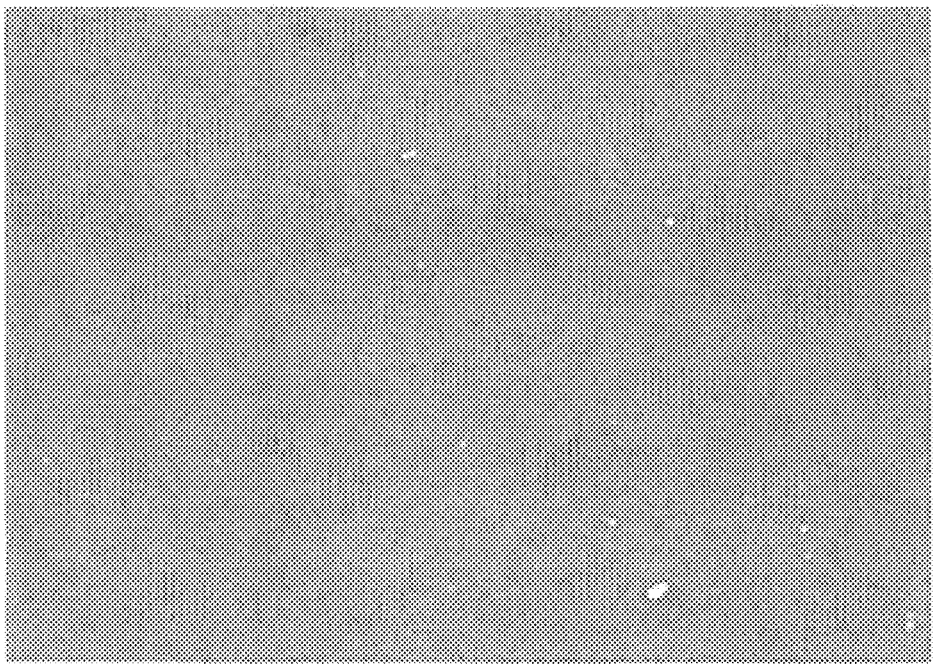
FIG. 3 illustrates the surface of type 347 stainless steel after mechanical polishing followed by electropolishing.

During the electropolishing step, a voltage can be established across the acid bath 10 and between the counter electrode 14 and the surface of the stainless steel piece 16 of from about 1 V to about 10 V. While the electropolishing step can be carried out at room temperature, in some embodiments, the electropolishing step can be carried out at an elevated temperature. For instance, the electropolishing step can be performed at a temperature of from about 30° C. to about 90° C. Higher temperatures can increase the reaction rates but may also promote pitting and as such an optimal balance can be found depending upon the particular materials and conditions employed. In order to maintain the temperature in a desired temperature range, it can be beneficial to pulse the voltage, for instance in increments of approximately 5 minutes so as to moderate the temperature. The total duration of the electropolishing step can depend upon the initial condition of the surface, although an extended time will not result in a significantly improved surface. For instance, an electropolishing step can be carried out over a period from about 2 minutes to about 30 minutes. FIG. 3 illustrates a type 347 stainless steel following an electropolishing step at 2000× magnification. As can be seen, the surface is quite smooth with niobium particles exposed at the surface.

Beneficially, the electropolishing step appears to have virtually no dependence on current density, this variable can dictate the length of time required to polish, i.e., a secondary variable. As is known, the solution resistance can be directly determined by the solution composition and temperature; the distance of the counter electrode 14 from the working piece 16 will directly impact the current density. This determines the voltage and current required to effectively polish the surface. The electropolishing step can remove chemical species and smooth the surface. In particular, the removal can be based on physical topography of the surface. Following the electropolishing step the upper regions of the work piece (i.e., at the surface as well as immediately below the surface) can be somewhat enriched in chromium as compared to prior to this step, but the regions will still include all of chromium, nickel, and iron in the metallic form as well as chromium oxide and iron oxide.

Following the electropolishing step, the work piece can be removed from the bath and rinsed (e.g., with water) and dried followed by subjection to a chromium surface enrichment step. The chromium enrichment step can provide for further enrichment of chromium at the surface as well as selective removal of iron and nickel species via a second electropolishing step that is performed at a relatively low voltage, e.g., from about 500 mV to about 1500 mV, from about 500 mV to about 1000 mV, or about 600 mV in some embodiments vs. Ag/AgCl reference electrode. The chromium enrichment step can utilize a system similar to that of the electropolishing step as illustrated in FIG. 2. However, the chromium enrichment step utilizes a fresh acid bath that can be the same or different composition as the acid bath of the electropolishing step. In addition, the electrodes of the chromium enrichment step can be the same or different as the electrodes of the electropolishing step. For instance, in one embodiment the chromium enrichment step can be carried out at about 600 mV vs. Ag—AgCl.

The chromium enrichment step can be carried out at room temperature or elevated temperature, as desired. For instance, the chromium enrichment step can be carried out at a bath temperature of between about 60° C. and about 90° C. in some embodiments. In addition, a chromium enrichment step can generally be carried out for a period of several hours, for instance about 4 hours or more, or from about 4 hours to about 16 hours in some embodiments, though longer total electroactive times may be employed as well. As with the electropolishing step it may be useful in some embodiments to intermittently apply the voltage across the acid bath to control the temperature of the process and/or to increase the efficiency of the step.

Figure 4:
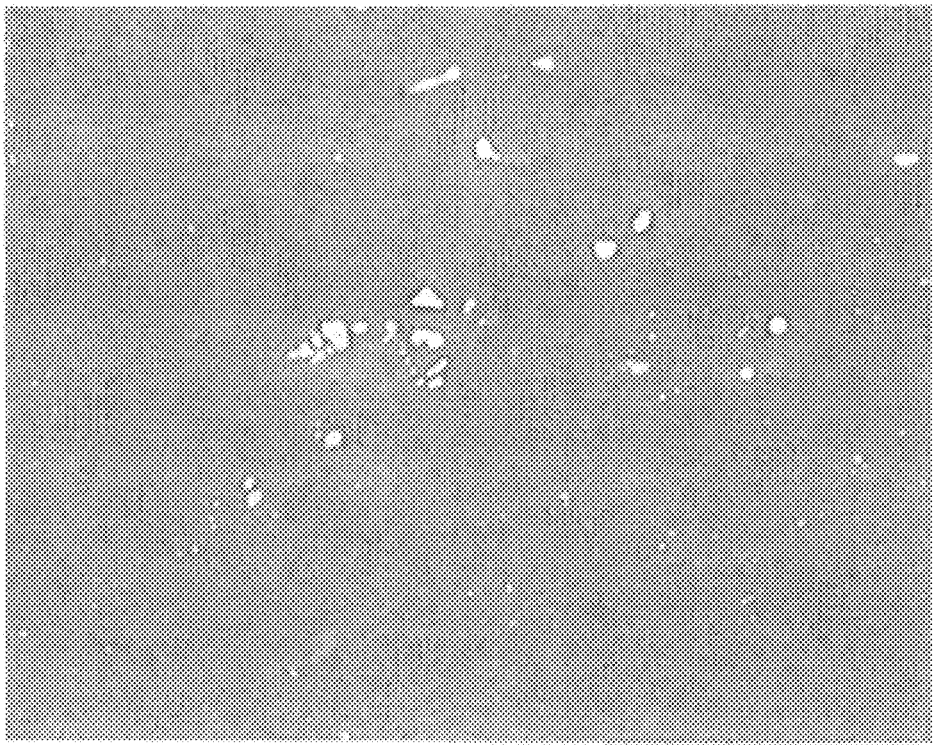
FIG. 4 illustrates the surface of type 347 stainless steel after mechanical polishing and electropolishing followed by a chromium enrichment step.

The chromium enrichment step can selectively remove iron and nickel from the surface, effectively increasing the chromium content at/near the surface. At the shorter time periods, e.g. about 4 hours, both nickel oxide and iron oxide presence in the work piece can be completely suppressed in the work piece and metallic iron and metallic nickel presence in the upper regions (e.g., the upper 2 nm or so) can likewise be suppressed. For instance, following about 4 hours, the upper 2 nm of a work piece can exhibit no iron, iron oxide, nickel or nickel oxide at all, with metallic iron and metallic nickel only occurring bellow this region. A longer treatment period, e.g., about 16 hours, does not appear to significantly further affect the presence of nickel species, but it does further effect the iron content of the steel. For instance, following about 16 hours of a chromium enrichment step, iron oxide can be present in the upper region of the piece (e.g., within the upper 4 nm or so), with metallic iron only occurring below this region. Thus upon a longer chromium enrichment step, iron oxide may begin to appear at/near the surface of a work piece, with metallic iron only occurring deeper. In all cases, however, the upper regions of the work piece can be enriched in chromium as compared to prior to the treatment step. Moreover, the surface of the work piece remains very smooth following the chromium enrichment step, as illustrated in FIG. 4.

The method can also include a vacuum heat treatment. In some embodiments, and as illustrated in the flow chart of FIG. 1, vacuum heat treatment can be carried out following the chromium enrichment process. In other embodiments, this step can be carried out at a different point in the process, for instance prior to the electropolishing step. In any case, the vacuum heat treatment is somewhat similar to those of previously known Q-passivation techniques but can vary in that it can be carried out at a lower temperature and pressure. To obtain the lower temperature and pressure conditions, a cycling temperature control mechanism can be utilized during, and optionally also following, the heating and evacuation of the vacuum container. For instance, the vacuum heat treatment can be carried out at an operating temperature of 400° C. or less in some embodiments, for instance from about 300° C. to about 400°, or about 350° C. In addition, the desired temperature and pressure conditions can be obtained via temperature cycling so as to better control the pressure in the containment vessel. As such the operating pressure over the course of the vacuum heat treatment step can be less than about $2.5\times10^{-6}$ Torr, about $10^{-6}$ Torr, about $5\times10^{-7}$ Torr, or about $10^{-7}$ Torr in some embodiments.

For example, as the vacuum furnace is heated to an operating temperature of about 400° C. or less (e.g., about 350° C.) and the pressure is decreased to an operating pressure of about $10^{-6}$ Torr or less (e.g., about $10^{-7}$ Torr), the temperature can be cycled over a temperature variation of from about ±50° C. to about ±100° C. on either side of an average temperature for that cycle while the average temperature for each incremental cycle steadily increases until the temperature in the container is at the targeted final temperature and pressure. The period of each cycle can vary in order to maintain the desired low pressure, however, in some embodiments the period of each cycle can be from about 15 minutes to about 30 minutes. Once the temperature and pressure conditions are attained, the vacuum heat treatment can be carried out over a period of time anywhere from a few hours (e.g., about 18 hours) to several hundred hours (e.g., about 500 hours).

As illustrated in the Examples section below, the temperature cycling during the vacuum heat treatment step can provide a route to maintain both temperature and pressure at very low levels (e.g. about 350° C. and about $10^{-7}$ Torr in some embodiments) during initiation and throughout the processing step. The low temperature/low pressure combination of the vacuum heat treatment step can provide several benefits to a treated work piece. Primarily, this step can decrease the hydrogen content of the stainless steel. This is important to limit hydrogen ingrowth and exchange in end applications. In addition, while the vacuum heat treatment can have little effect on overall species concentration at and near the surface, it can initiate chromium oxide growth at the surface of the object, for instance within a region of about 2 nm in depth from the surface. In addition, the low temperature/low pressure vacuum heat treatment step can remove hydrolyzed water present on the surface. With sufficient temperature and low pressure, physisorbed and chemisorbed water can become mobile and be liberated from the surface, allowing the surface oxide to relax to a state that is less favorable for chemisorption of water, thereby reducing hydrogen from the surface.

As a final step, a controlled oxidation process can be carried out that includes heating the steel in the presence of low partial pressures of oxygen. For instance, the surface can be contacted with an $O_2$/inert atmosphere (e.g., $O_2$/argon) at a partial pressure of oxygen of about 10% or less, or about 5% or less, or about 1% or less, or 100 ppm or less, for instance from about 1 ppm to about 10% and at a temperature of from about 100° C. to about 500° C., for instance about 400° C., for a period of time of about 4 hours. A controlled oxidation step is not limited to these values, however, and lower oxygen partial pressure can be utilized in some embodiments, for instance on the order of 0.01 to 10% $O_2$ at 0.01 mTorr.

Figure 5:
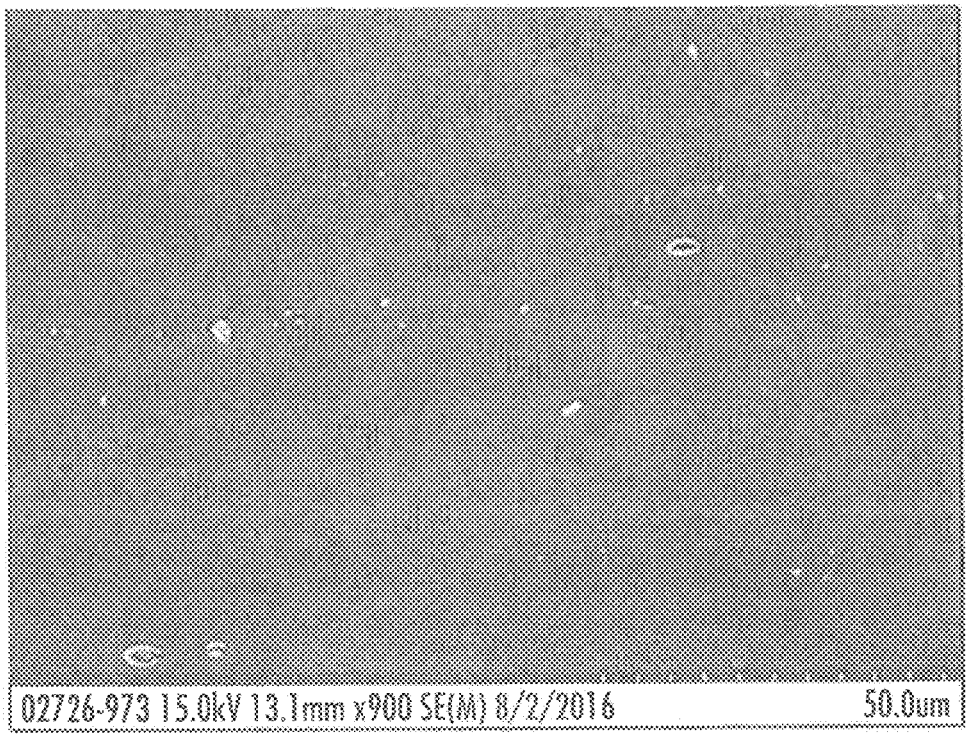
FIG. 5 illustrates the surface of a type 300 series stainless steel following all steps of a process as illustrated in FIG. 1.

The low oxygen partial pressure heat treatment can encourage chromium oxide formation while minimizing formation of iron oxide. In particular, and while not wishing to be bound to any particular theory, it is surmised that the low oxygen partial pressure can allow chromium atoms from the bulk to migrate to the surface as the chromium atoms at the surface oxidize. This migration and oxidation process can result in an increased chromium/oxygen enriched layer, effectively decreasing the probability of hydrogen isotope exchange with the surface of the steel. By carrying out the controlled oxidation step at controlled oxygen pressures, the formation of iron oxide at the surface can be limited or suppressed and the near surface of the work piece can be high purity chromium oxide with relatively low amounts of iron oxide. FIG. 5 illustrates a type 300 series stainless steel surface following a controlled oxidation step.

The Q-passivation process as described can be applied to stainless steel for use in a number of applications, but may be particularly useful for application in fusion reactors, gas sample bottles, and other operations that require high cleanliness gas service lines. For instance, the methods can be applied as surface treatments for gas sample bottles for air monitoring, high pressure gas sample bottles that require high purity inert surfaces, and gas manifold fabricators, just to name a few.

The present disclosure may be better understood with reference to the Examples set forth below.

EXAMPLE 1

Sample coupons, 6 mm×12 mm×50 mm, made of Type 304L stainless steel were used with copper counter electrodes in the electropolishing bath. A single electropolishing step was carried out followed by vacuum heat treatment as described above. Samples were varied according to the acid electropolishing composition, current density, polishing time, and acid bath temperature as shown in Table 1.

TABLE 1

| Sample No. | Acid Ratio ($H_2SO_4$:$H_3PO_4$) | Current Density (mA/cm$^2$) | Temp (° C.) | Time |
|---|---|---|---|---|
| 1 | 60:40 | 10 | 30 | 2 |
| 2 | 60:40 | 100 | 50 | 10 |
| 3 | 60:40 | 1000 | 70 | 20 |
| 4 | 50:50 | 10 | 50 | 20 |
| 5 | 50:50 | 100 | 70 | 2 |
| 6 | 50:50 | 1000 | 30 | 10 |
| 7 | 70:30 | 10 | 70 | 10 |
| 8 | 70:30 | 100 | 30 | 20 |
| 9 | 70:30 | 1000 | 50 | 2 |

Figure 6:
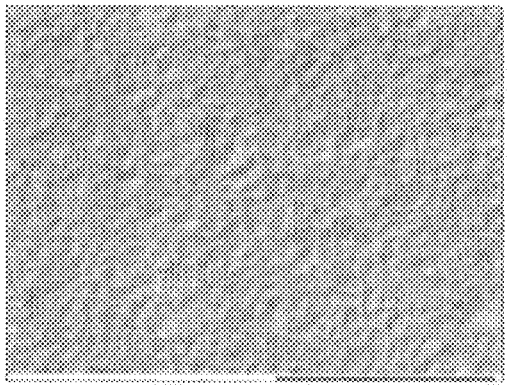
FIG. 6 illustrates a stainless steel surface following mechanical polishing and electropolishing.
Figure 7:
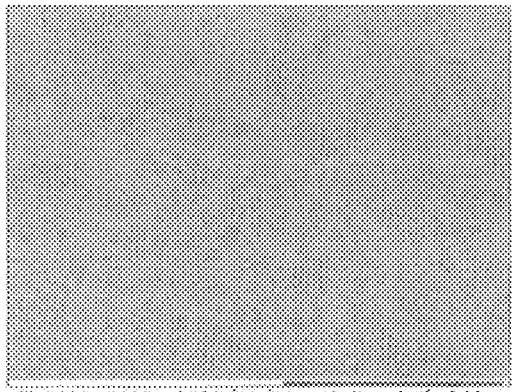
FIG. 7 illustrates another stainless steel surface following mechanical polishing and electropolishing.
Figure 8:
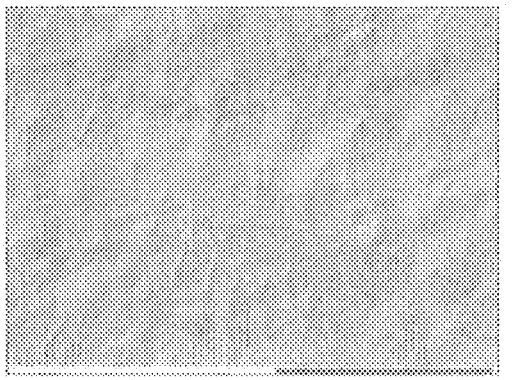
FIG. 8 illustrates another stainless steel surface following mechanical polishing and electropolishing.
Figure 9:
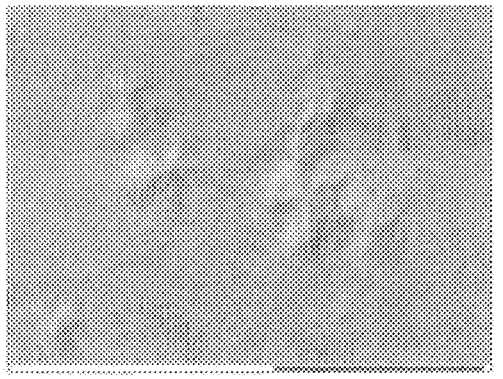
FIG. 9 illustrates another stainless steel surface following mechanical polishing and electropolishing.

After electropolishing under the conditions described for each sample in Table 1, each sample solution was characterized by Inductively Coupled Plasma-Optical Emission Spectrometers (ICP-OES) analysis to characterize the elemental content in each used electropolishing solution. The electropolishing conditions resulted in two visually distinct surfaces, a smooth, mirrored finish and a matte, frosted gray, finish. The matte surfaces were typically associated with higher sulfuric to phosphoric acid ratios at higher temperatures and voltages. These conditions apparently etch rather than polish the surfaces. Scanning electron microscopy (SEM) images in FIG. 6 (sample #3), FIG. 7 (sample #6), FIG. 8 (sample #7) and FIG. 9 (sample #9) show examples of representative surface characteristics each at 1000× magnification.

ICP-MS analysis of each electropolishing solution was performed after each test and it was determined that for the conditions tested in Table 1 the resulting concentrations of Cr, Fe, and Ni in each solution were similar to that of the base metal composition. Although there were subtle differences in the oxide layer measured, none of the conditions tested appeared to be ideal for chromium enrichment. The 60:40 sulfuric acid:phosphoric acid solution was found to provide greater chromium content, but the 50:50 mixture provided the smoothest surface finish.

Higher current densities appeared to produce thicker oxygen enriched layers, although they were very aggressive and did not yield significant chromium enhancement. With higher current densities, the surface and polishing bath compositions indicated an equal removal of all elements from the base metal. As such, the single electropolishing step was found to not be ideal for chromium enrichment.

Figure 10:
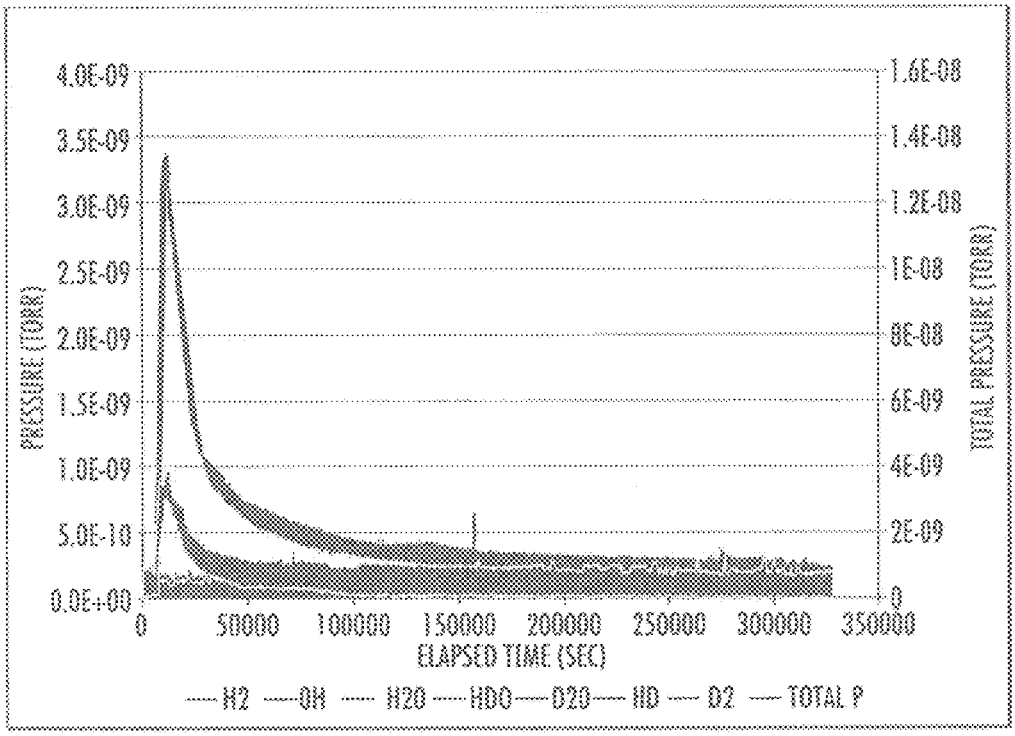
FIG. 10 graphically illustrates the out-gassing characteristics obtained for several components during a vacuum heat treatment step.

Following the single electropolishing step, the samples were subjected to vacuum heat treatment under relatively low temperature. FIG. 10 shows the out-gassing results of a vacuum heating step as described herein where the samples were held at nominally 350° C.

Figure 11:
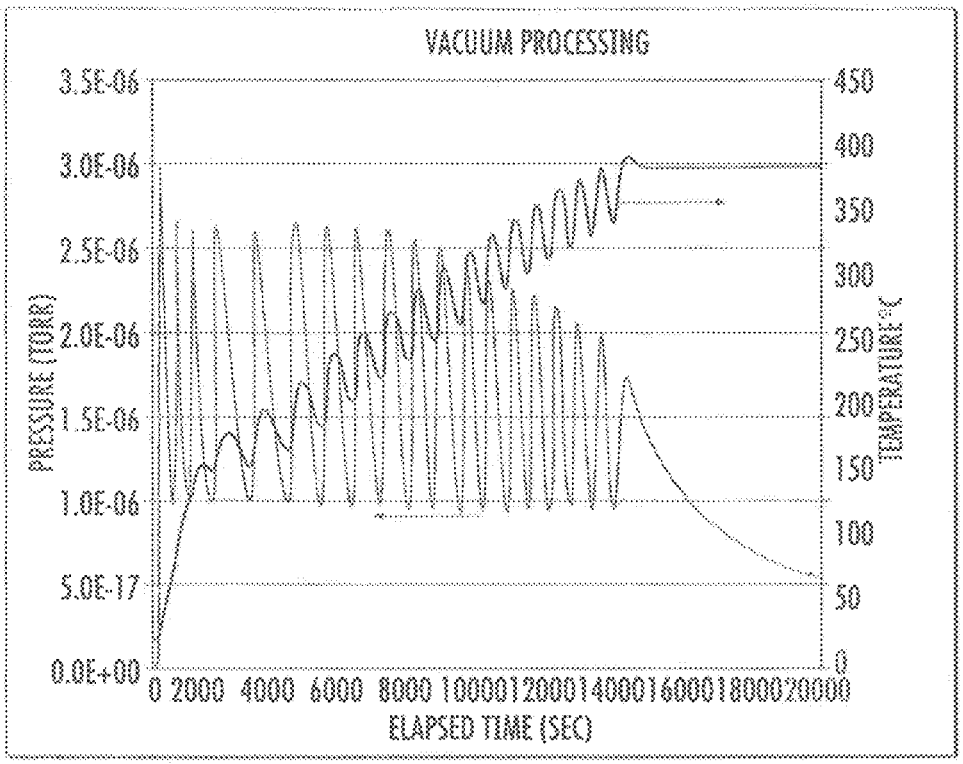
FIG. 11 illustrates the temperature cycling used to maintain the relatively low temperature/low pressure (high vacuum condition) vacuum during heating.
Figure 12:
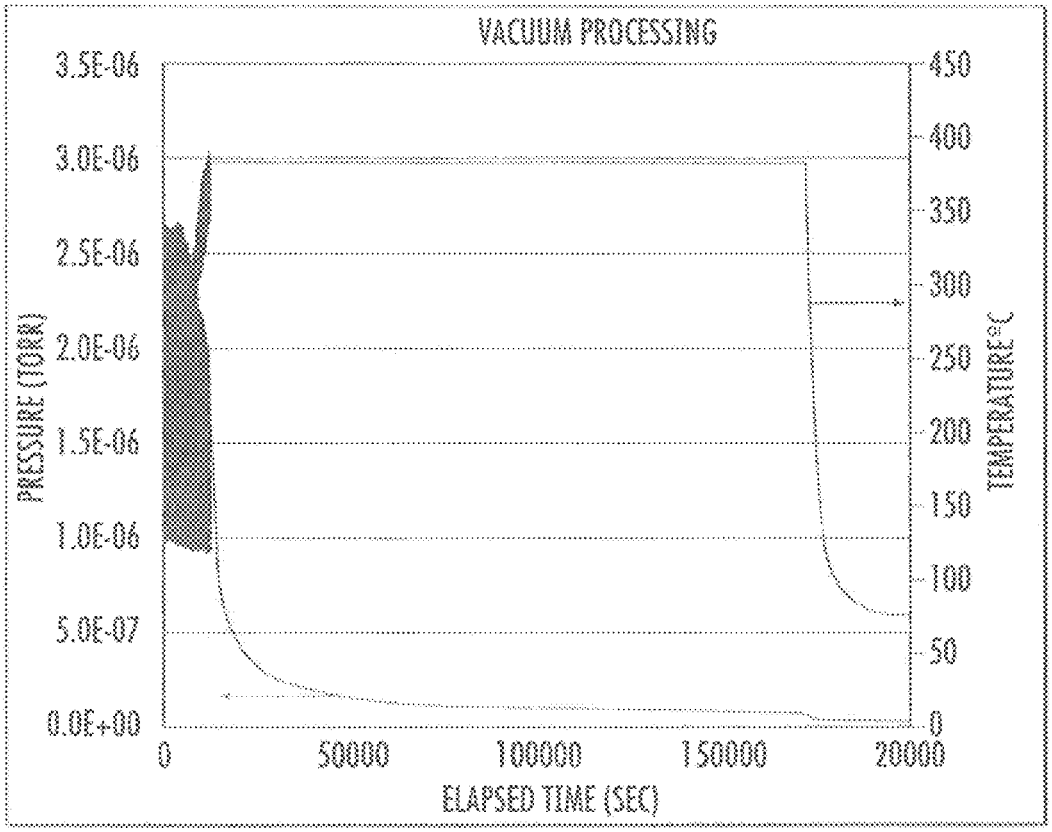
FIG. 12 illustrates the temperature and pressure throughout a vacuum heat treatment step.

FIG. 11 and FIG. 12 illustrate the temperature cycling used to maintain both the low temperature and low pressure during ramp up (FIG. 11) and throughout (FIG. 12) the vacuum heat treatment.

During the low temperature, low pressure vacuum treatment, hydrogen began to evolve immediately upon heating and peaked at a relatively high relative pressure. Note that the reported pressure is the imputed pressure from the residual gas analyzer so it may be off by several orders of magnitude compared to the actual furnace pressure.

EXAMPLE 2

Type 304L stainless steel materials were processed as described below and examined for chromium and iron content.

FIG. 13 illustrates a stainless steel surface following mechanical polishing using 180, 240, 400, and 600 grit silicon carbide papers on a rotating wheel after rinsing with water and drying with alcohol, as observed using the scanning electron microscope Following cleaning, the stainless steel was then subjected to electropolishing in a 50:50 $H_2SO_4$:$H_3PO_4$ solution using a copper counter electrode (10 V for increments of approximately 5 minutes for temperature control). The bath was initially heated to 50° C. and then temperature controlled so as to no exceed 70° C. Total processing time was 20 minutes. The coupons were then rinsed and dried.

Following the electropolishing step, electrochemical chromium enrichment of the surface was carried out in a fresh 50:50 $H_2SO_4$:$H_3PO_4$ solution using an Ag/AgCl counter electrode. The processing was carried out at a voltage of 600 mV for a time period of 16 hours during which the system was operated at room temperature. The coupons were then rinsed and dried.

Figure 14:
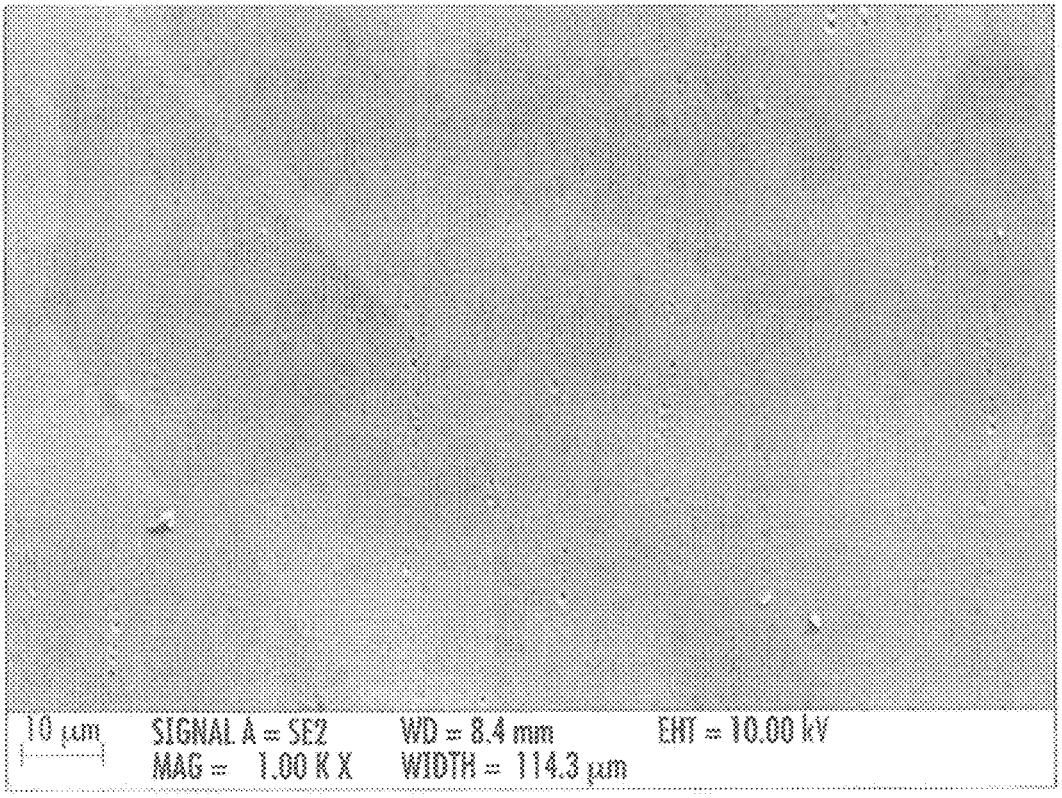
FIG. 14 illustrates a stainless steel surface following cleaning, mechanical polishing, electropolishing, and a chromium enrichment step.

FIG. 14 illustrates the surface following the mechanical polishing, electropolishing, and electrochemical chromium enrichment steps. As shown, all grinding marks from the mechanical polishing process have been removed.

Figure 15:
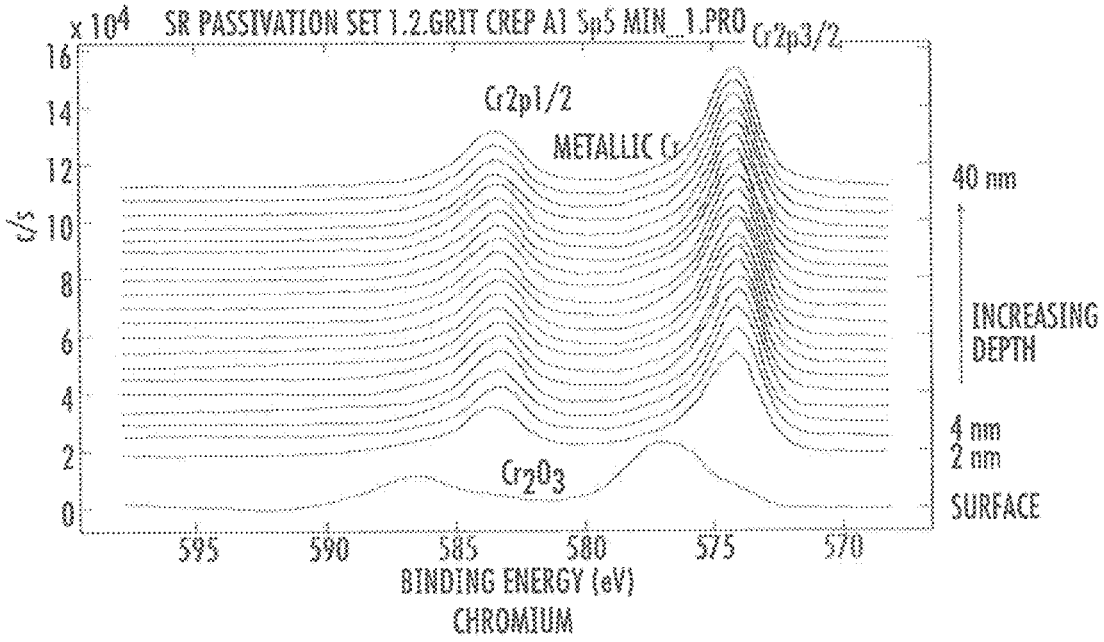
FIG. 15 presents the X-ray photoluminence spectroscopy (XPS) data for chromium content of a stainless steel surface following mechanical polishing, electropolishing and electrochemical chromium enrichment steps.

FIG. 15 presents the XPS data for chromium content of a typical surface following the mechanical polishing, electropolishing and electrochemical chromium enrichment steps. As shown, chromium oxide is present at the surface but all chromium is metallic by 2 nm depth.

A vacuum heat treatment step was then carried out during which the stainless steel work piece was placed in a vacuum furnace and evacuated overnight (about 12 hours) to a target pressure at room temperature of $10^{-7}$ Torr or less. Following, the work piece was heated in a cyclic manner such that the internal temperature of the furnace did not exceed 400° C. (generally less than about 350° C. as illustrated in FIG. 11) and the internal pressure of the furnace did not exceed $2.5\times10^{-6}$ Torr. After a treatment time, the temperature was allowed to return to ambient and the furnace was evacuated until the pressure returned to approximately the initial vacuum pressure.

Figure 16:
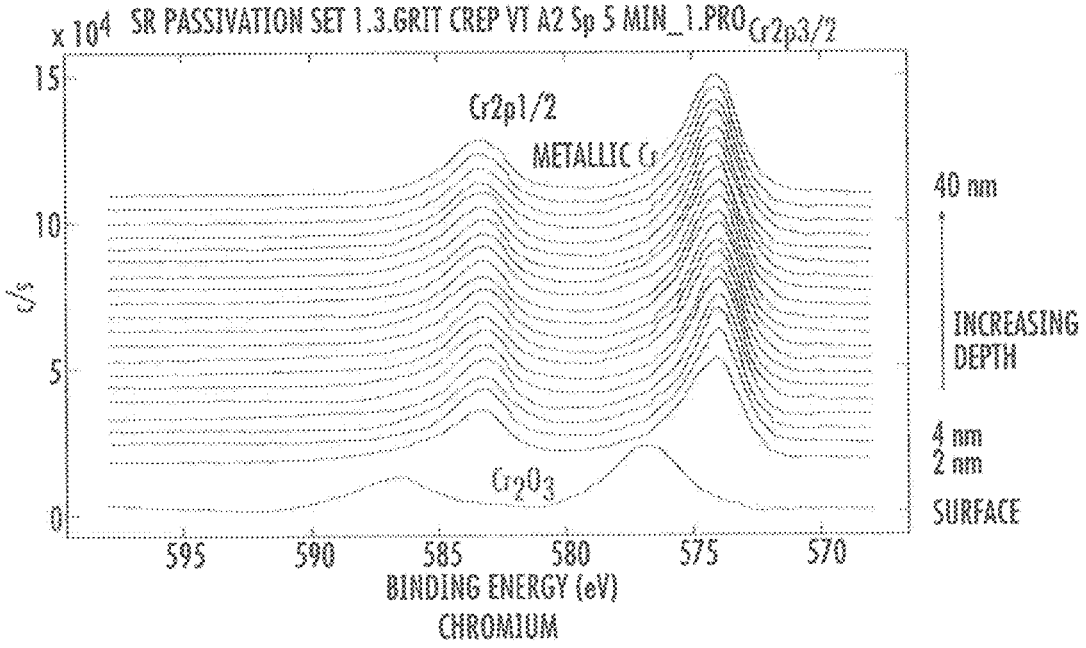
FIG. 16 presents XPS data for chromium content of a stainless steel surface following mechanical polishing, electropolishing, chromium enrichment and vacuum heat treatment.

FIG. 16 presents XPS data for chromium content of a typical surface following the heated vacuum treatment. As shown, chromium oxide was present at the surface, and all chromium was metallic by 2 nm depth. Thus, the vacuum heat treatment did not appear to significantly grow the chromium oxide layer.

A controlled oxidation step was then carried out with the introduction of a 1% oxygen/argon mixture to the vacuum furnace at room temperature and the temperature of the furnace was controlled at 350° C. for a period of 4 hours.

Figure 17:
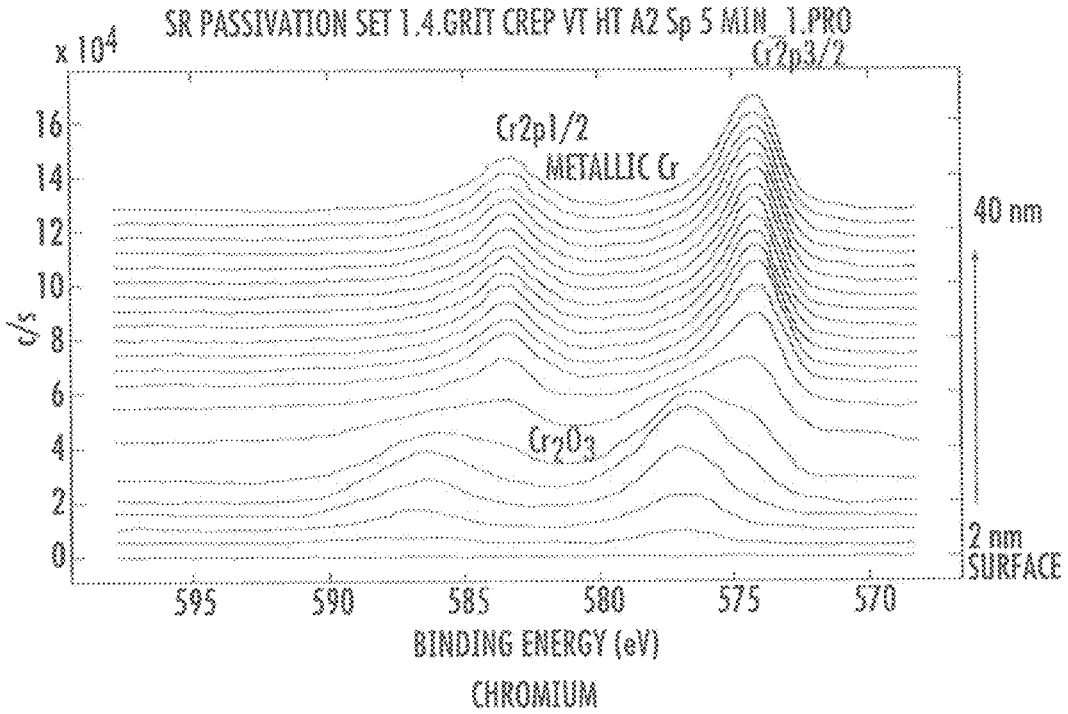
FIG. 17 presents XPS data for chromium content of a stainless steel surface following mechanical polishing, electropolishing, chromium enrichment and vacuum heat treatment and a controlled oxidation step.

FIG. 17 shows the XPS data for the chromium content of a typical coupon. As shown, chromium oxide was present through 12 nm of coupon depth, with purely metallic chromium by 14 nm.

Figure 18:
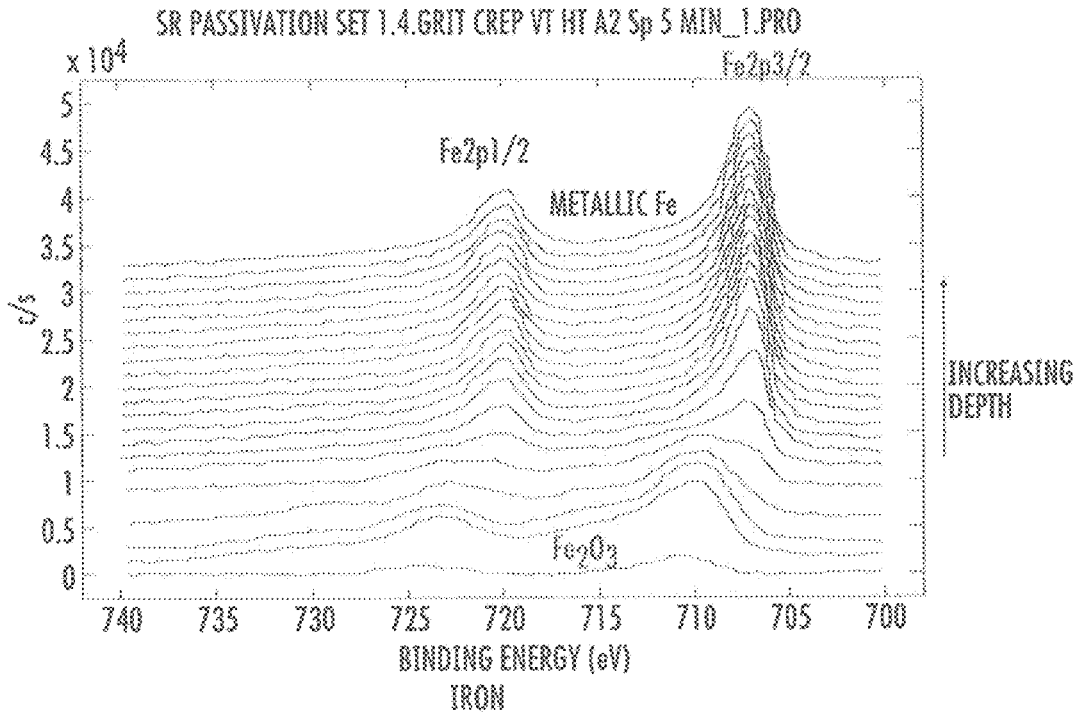
FIG. 18 presents XPS data for iron content of a stainless steel surface following mechanical polishing, electropolishing, chromium enrichment and vacuum heat treatment and a controlled oxidation step.

FIG. 18 presents the XPS data for iron content of a typical surface following the controlled oxidation step. As shown, iron was oxidized through 8 nm with metallic iron by 10 nm.

EXAMPLE 3

Stainless steel was processed as described above in Example 2 with the chromium enrichment step carried out for either a 4 hour treatment time or a 16 hour treatment time. A summary of the results are given in Table 2, below.

TABLE 2

| | Depth of layer, nm, 0 nm is surface | | | | |
|---|---|---|---|---|---|
| Time, hrs | $CrO_x$ | Fe | $FeO_x$ | Ni | $NiO_x$ |
| 4 | 0 to 4 | 2 to base | None | 2 nm to base | None |
| 16 | 0 to 4 | 4 to base | Surface to 4 nm | 2 nm to base | None |
| 1 V to 10 V EP | | | 0 to base | | None |

Figure 19:
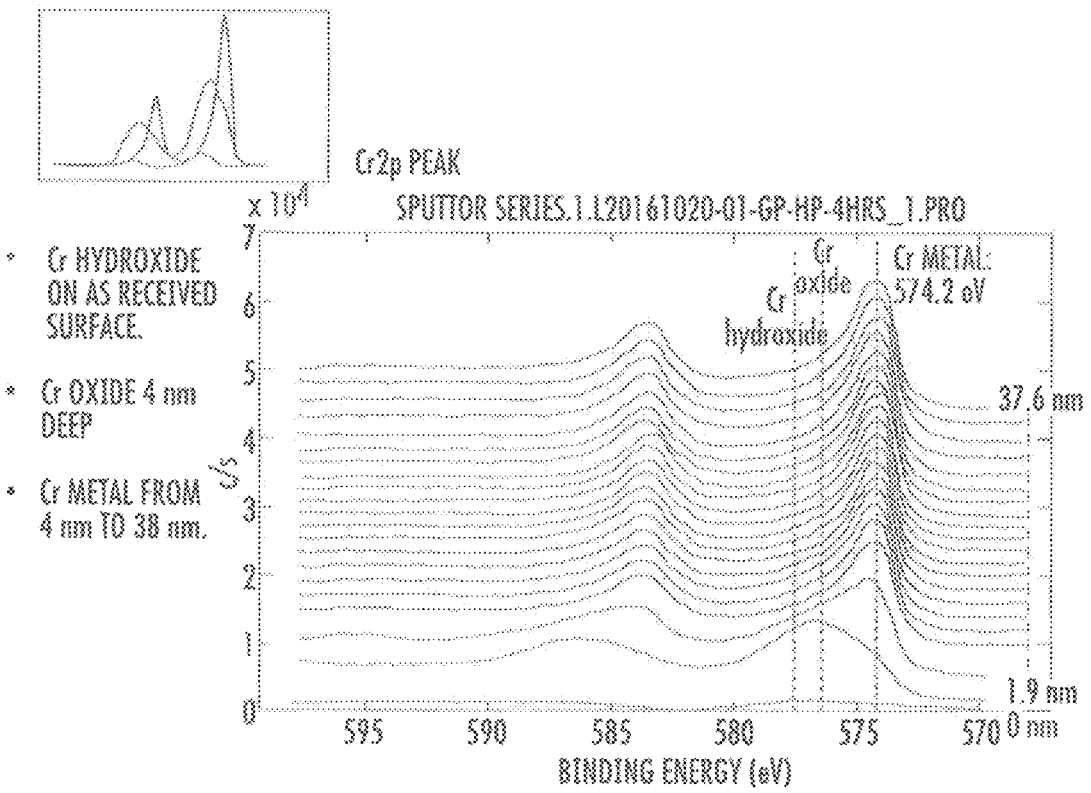
FIG. 19 presents XPS data for chromium content of a stainless steel surface following mechanical polishing, electropolishing and a 4 hour chromium enrichment step.
Figure 20:
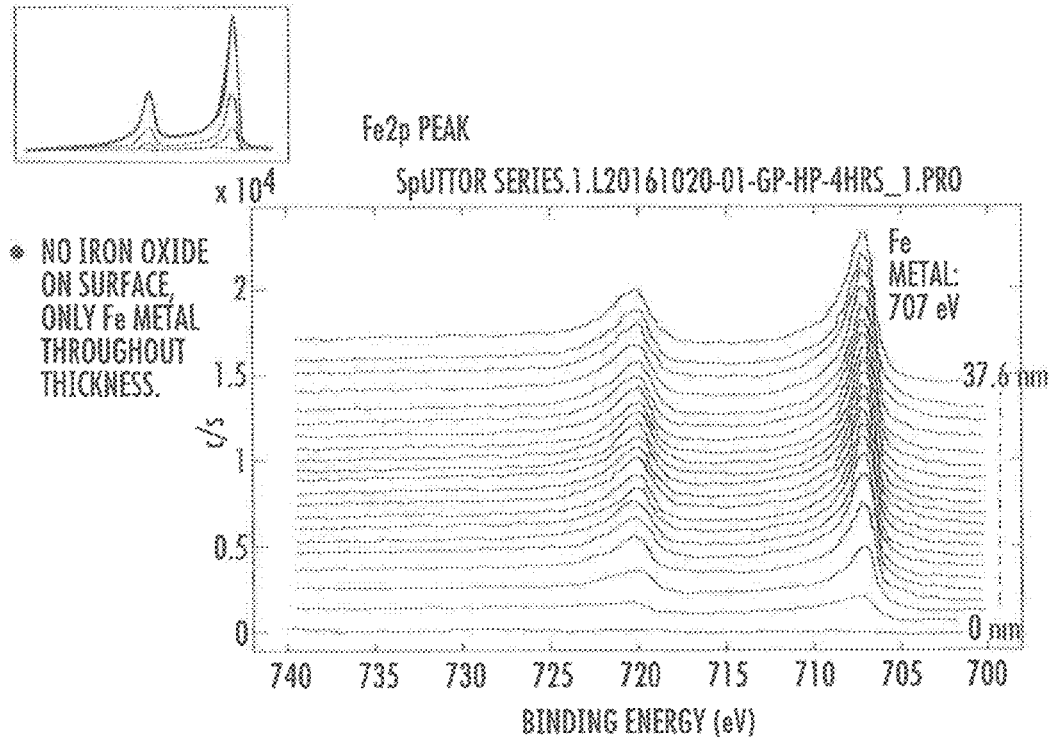
FIG. 20 presents XPS data for iron content of a stainless steel surface following mechanical polishing, electropolishing and a 4 hour chromium enrichment step.
Figure 21:
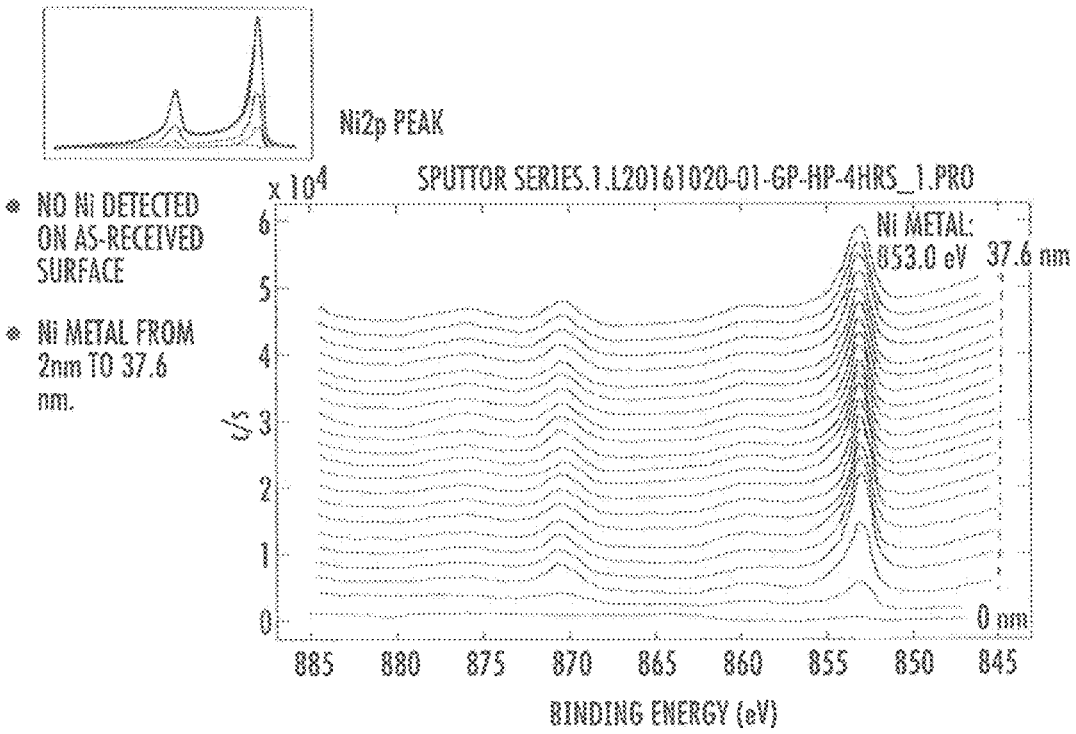
FIG. 21 presents XPS data for nickel content of a stainless steel surface following mechanical polishing, electropolishing and a 4 hour chromium enrichment step.
Figure 22:
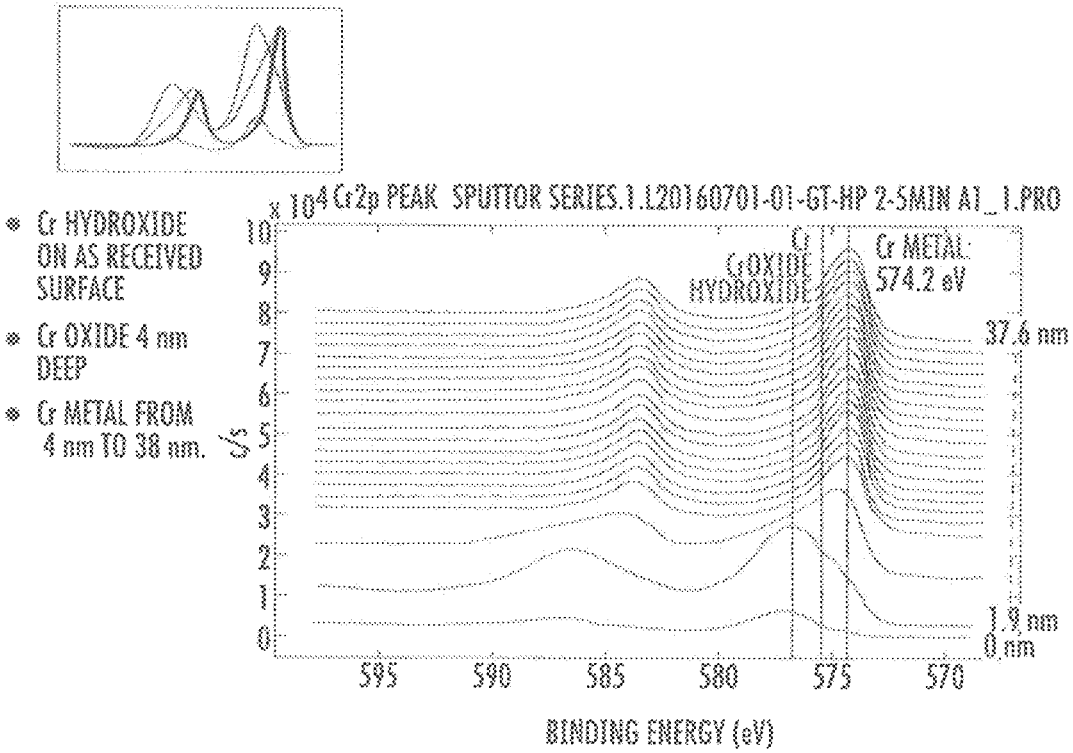
FIG. 22 presents XPS data for chromium content of a stainless steel surface following mechanical polishing, electropolishing and a 16 hour chromium enrichment step.
Figure 23:
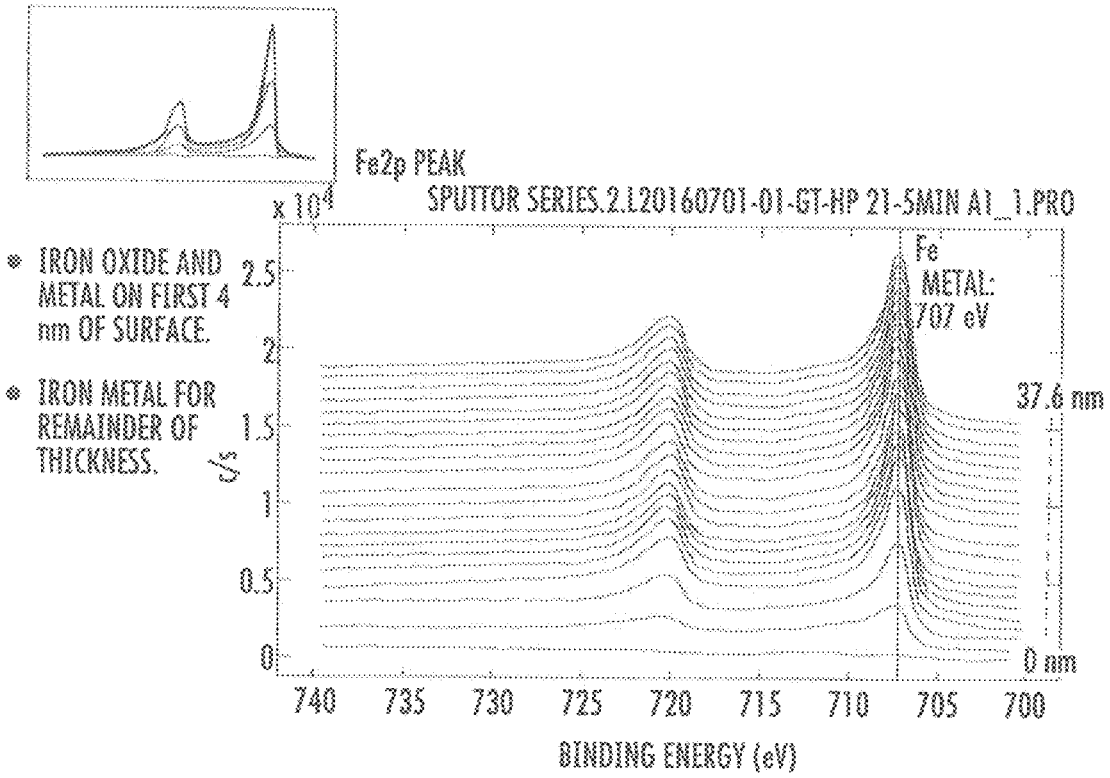
FIG. 23 presents XPS data for iron content of a stainless steel surface following mechanical polishing, electropolishing and a 16 hour chromium enrichment step.
Figure 24:
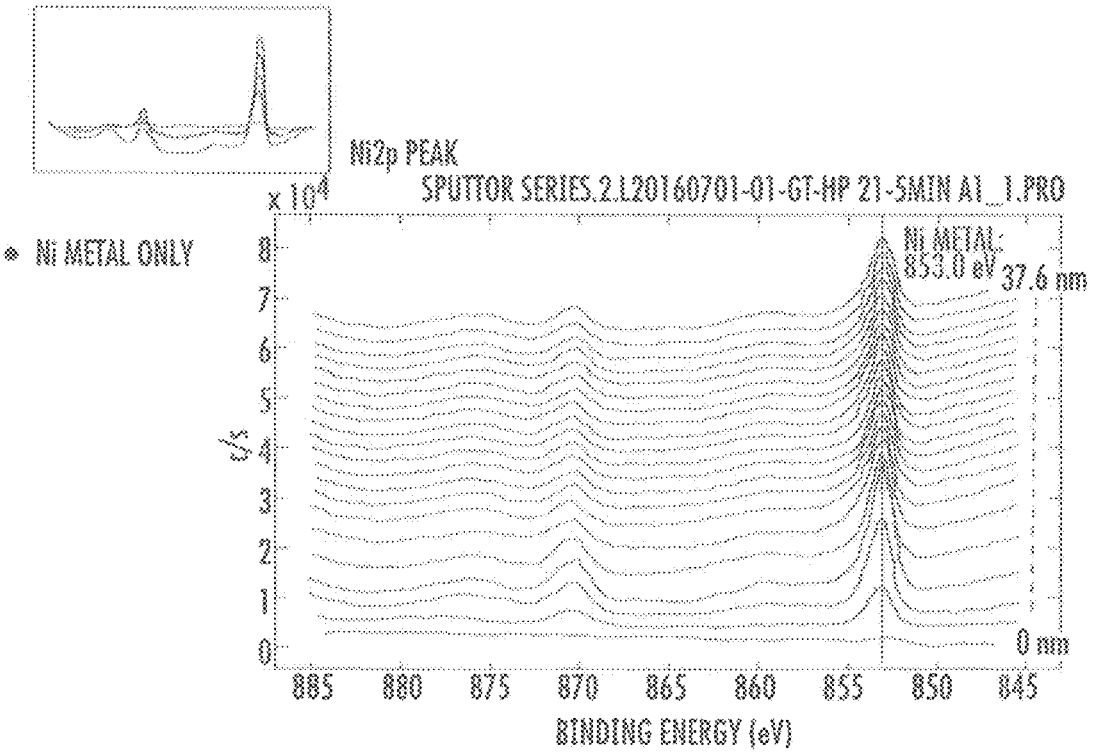
FIG. 24 presents XPS data for nickel content of a stainless steel surface following mechanical polishing, electropolishing and a 16 hour chromium enrichment step.

FIG. 19, FIG. 20, and FIG. 21 illustrate the XPS data for chromium, iron, and nickel, respectively, for the materials that underwent a 4 hour chromium enrichment step. FIG. 22, FIG. 23, and FIG. 24, illustrate the XPS data for chromium, iron, and nickel, respectively for the materials that underwent a 16 hour chromium enrichment step. As shown in FIG. 19, the XPS data shows that both chromium hydroxide and chromium oxides are formed after the electropolishing and 4 hr chromium enrichment steps. In FIG. 20 it is seen that there is no formation of iron oxide after the electropolishing and 4 hr chromium enrichment steps. FIG. 21 shows the absence of nickel at the surface after the electropolishing and 4 hr chromium enrichment steps. Following the 16 hour chromium enrichment step, the chromium hydroxide is increased to 2 nm vs. only on the surface after the 4 hr step, but there is no significant increase in chromium oxide thickness (FIG. 22). As seen in FIG. 23, there is a weak indication of iron oxide presence after the electropolishing and 16 hour chromium enrichment step, and FIG. 24 demonstrates no nickel at the surface after the 16 hour chromium enrichment step.

The chromium enrichment polarization step of 600 mV vs. Ag/AgCl electrode shows a removal of nickel from the surface at both time periods thus enhancing the chromium and iron content of the top 2 nm by about 8%. At the shorter 4-hr chromium enrichment time, the iron and iron oxide were suppressed as well.

Figure 25:
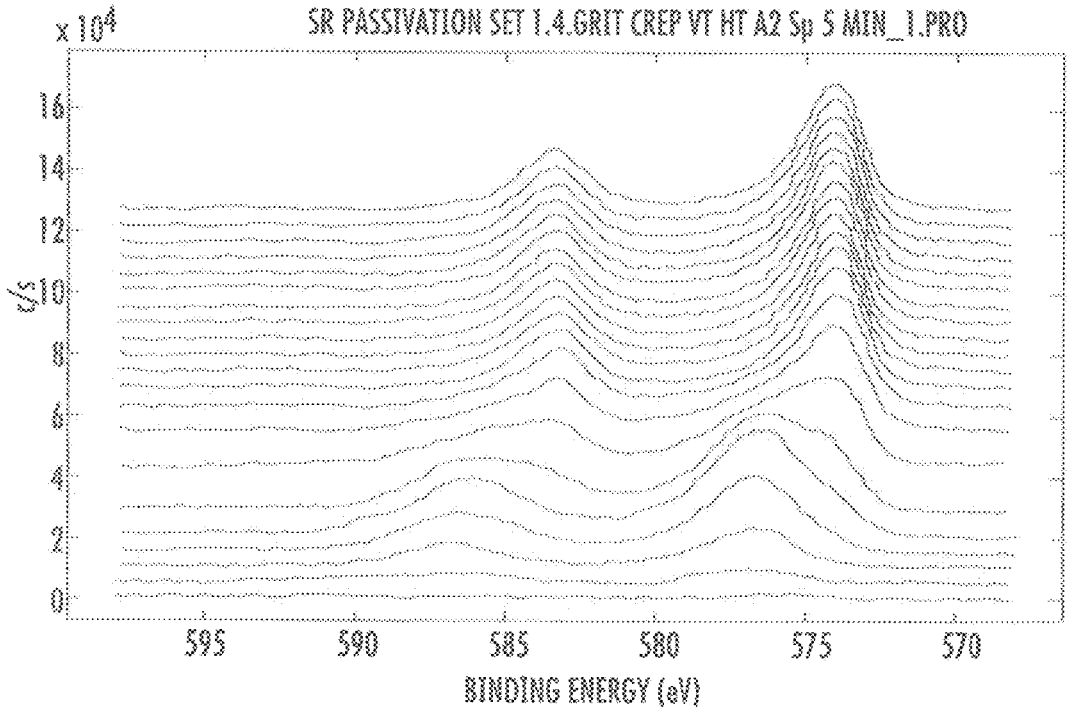
FIG. 25 presents XPS data for chromium content following a Q-passivation process as described herein, i.e., mechanical polishing, electropolishing, chromium enrichment, vacuum extraction, and oxidation steps.
Figure 26:
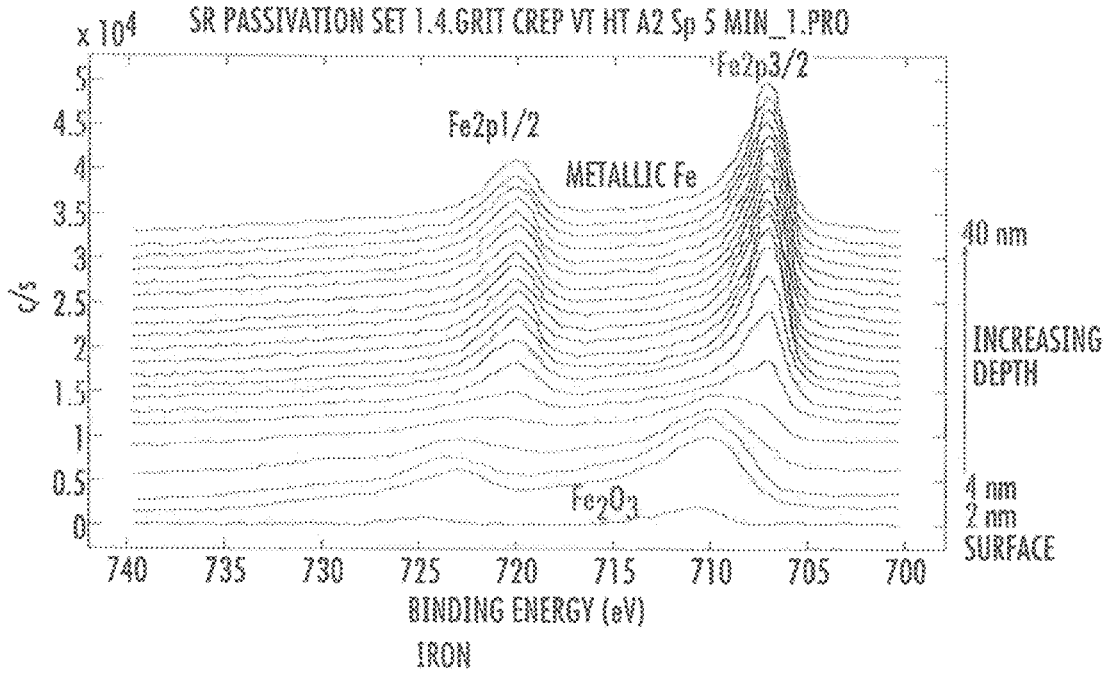
FIG. 26 presents XPS data for iron content following a Q-passivation process as described herein.

FIG. 25 presents the XPS data for chromium content and FIG. 26 presents the XPS data for the iron content of the fully processed sample formed by use of the 16 hr chromium enrichment step. As can be seen the sample shows a thick chromium oxide layer following all of the processing steps, including electropolishing, chromium enrichment, vacuum heat treatment, and controlled oxidation. XPS analysis of FIG. 25 and FIG. 26 show the oxide depth to roughly 15 nm.

Figure 27:
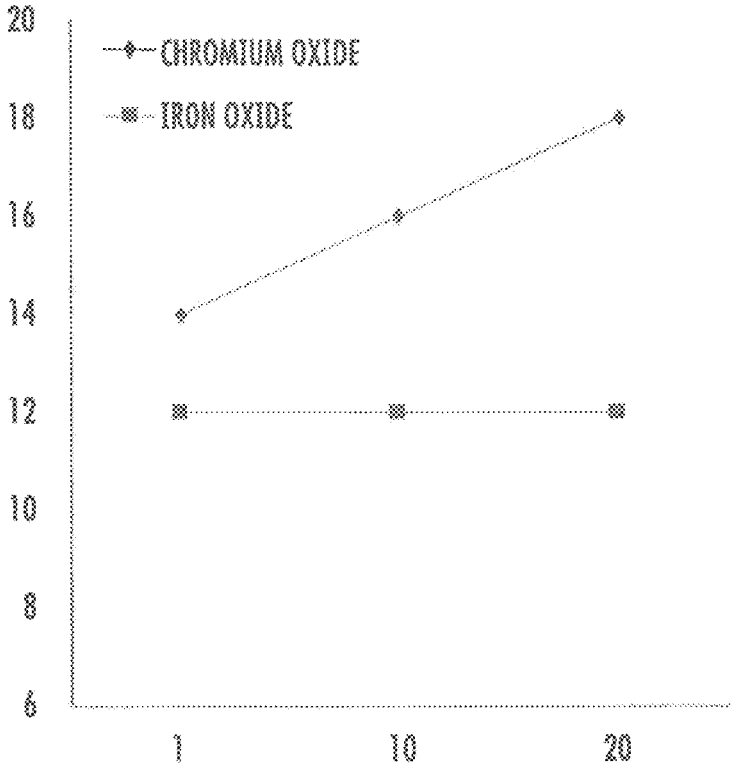
FIG. 27 compares chromium oxide depth and iron oxide depth as a function of oxygen partial pressure during the controlled oxidation step after mechanical polishing, electropolishing, chromium enrichment, and vacuum extraction.

FIG. 27 graphically compares the iron oxide and chromium oxide thickness vs. oxygen partial pressure used during the controlled oxidation step. As shown, there is little effect of oxygen partial pressure, in the range of 1 to 10%, on the iron oxide thickness, while chromium oxide increases with oxygen partial pressure. It is surmised that the iron oxide forms initially on the surface and the chromium oxide initiates after.

Figures 28A, 28B:
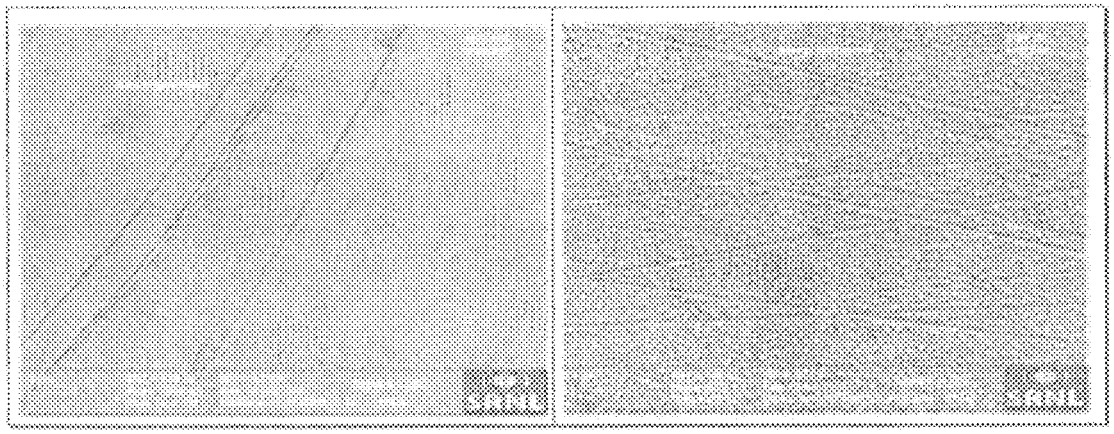
FIG. 28 illustrates a stainless steel surface following electropolishing and vacuum heat treatment and the same surface also following a controlled oxidation step.

FIG. 28 shows an SEM image of a surface (left) that has been electropolished, chromium enriched and vacuum heat treated. The surface is shown on the right after an additional heat treatment surface with 1% oxygen at 350° C. for 4 hours. The notable change in roughness is due to the formation of the surface oxide layer that is grown in the oxidation oven. SEM analysis of the region showed an increase of 0.5% for the total interaction volume that had a depth of about 200 nm. XPS analysis showed the oxide depth was on the order of 15 nm, therefore the 0.5% increased oxide thickness occurs at the upper 15 nm of the 200 nm SEM-measurement, i.e. the oxide formation is at the surface.

While certain embodiments of the disclosed subject matter have been described using specific terms, such description is for illustrative purposes only, and it is to be understood that changes and variations may be made without departing from the spirit or scope of the subject matter.

What is claimed is:

1. A method for treating stainless steel comprising:

immersing a surface comprising stainless steel at the surface in a first acid bath; applying a voltage of from about 1 V to about 10 V across the first bath and between the surface and a first electrode;

following, immersing the surface in a second acid bath; applying a voltage of from about 500 mV to about 1500 mV across the second bath and between the surface and a second electrode; and following, subjecting the surface to a vacuum pressure of about $2.5\times10^{-6}$ Torr or less for a period of time of about 18 hours or more, the surface being heated at a temperature of about 400° C. or less as the surface is subjected to the vacuum pressure, wherein as the surface is subjected to the vacuum pressure, the surface is heated according to a cyclic heating process for the period of time, each cycle encompassing a temperature variation of from about 50° C. to about 100° C. on either side of an average temperature for that cycle, the average temperature for each consecutive cycle increasing toward a target temperature.

2. The method of claim 1, further comprising following subjection of the surface to the vacuum pressure, contacting the surface with a mixture of oxygen and an inert gas, the mixture containing the oxygen in an amount of about 10% or less.

3. The method of claim 2, further comprising heating the surface as it is contacted with the mixture.

4. The method of claim 3, wherein the surface is heated at a temperature of from about 100° C. to about 500° C. as the surface is contacted with the mixture.

5. The method of claim 2, wherein the inert gas is argon.

6. The method of claim 2, wherein the mixture contains the oxygen in an amount of from about 0.01% to about 10%.

7. The method of claim 1, wherein the first acid bath includes sulfuric acid and phosphoric acid.

8. The method of claim 7 wherein the first acid bath includes the sulfuric acid and the phosphoric acid in a ratio of from about 70:30 to about 50:50.

9. The method of claim 1, wherein the voltage across the second bath is from about 500 mV to about 1500 mV vs. Ag/AgCl as a reference and/or a counter electrode.

10. The method of claim 1, wherein the second acid bath includes sulfuric acid and phosphoric acid.

11. The method of claim 10 wherein the first second bath includes the sulfuric acid and the phosphoric acid in a ratio of from about 70:30 to about 50:50.

12. The method of claim 1, wherein the voltage is established across the first bath multiple times consecutively.

13. The method of claim 1, wherein as the surface is subjected to the vacuum pressure, the vacuum pressure is about $5\times10^{-7}$ Torr or less for the period of time.

14. The method of claim 13, wherein the surface is heated at a temperature of about 350° C. or less for the period of time.

* * * * *